United States Patent [19]

Weber

[11] Patent Number: 4,538,204

[45] Date of Patent: Aug. 27, 1985

[54] CORONA PRODUCING METHOD AND APPARATUS

[75] Inventor: Harold J. Weber, Sherborn, Mass.

[73] Assignee: Coulter Systems Corporation, Bedford, Mass.

[21] Appl. No.: 348,762

[22] Filed: Feb. 16, 1982

[51] Int. Cl.[3] ..... H01T 19/00

[52] U.S. Cl. ..... 361/229; 361/225; 250/325; 250/326

[58] Field of Search ..... 361/225, 229, 230, 213; 250/324, 325, 326

[56] References Cited

U.S. PATENT DOCUMENTS

| | | | |
|---|---|---|---|
| 3,233,156 | 2/1966 | Jarvis et al. | 361/229 |
| 3,247,430 | 4/1966 | Streiffert | 361/230 |
| 3,958,162 | 5/1976 | Kuehnle | 361/229 |
| 4,056,723 | 11/1977 | Springett et al. | 250/326 X |
| 4,068,284 | 1/1978 | Wheeler et al. | 361/229 X |

*Primary Examiner*—Reinhard J. Eisenzopf

*Attorney, Agent, or Firm*—Silverman, Cass & Singer, Ltd.

[57] ABSTRACT

A method and apparatus for producing a uniform elongate corona is provided. The apparatus includes at least one stationary corona electrode coupled to a supply of corona voltage. A moving ground electrode having a series of equally-spaced grounding points is coupled to a bias circuit that returns to ground. The moving ground electrode may be arranged to form a helix on a motor-driven insulating rod, with the longitudinal axis of the rod parallel to the stationary elongate corona electrode at a predetermined distance therefrom. The supply of corona power provides a high negative D.C. voltage or a series of high frequency negative high voltage pulses. The preferred bias circuits include one of a self-bias provided by a high resistance; a high frequency pulsating D.C. power supply circuit; or a fixed value negative D.C. power supply circuit. The moving ground electrode may also embody a moving endless belt having rectangular openings that serve to form a ladder having crossbars of uniform size and spacing within the endless belt, with the crossbars extending perpendicular to the stationary corona electrode and defining the grounding points. The method includes the steps of applying a source of corona power to at least one stationary elongate corona electrode, and moving an elongate ground electrode having a series of equally-spaced grounding points such that the grounding points move along an axis defined parallel to the stationary corona electrode, thereby effecting a substantially uniform corona discharge along the length of the stationary corona electrode.

13 Claims, 7 Drawing Figures

CORONA PRODUCING METHOD AND APPARATUS

CROSS-REFERENCE TO COPENDING APPLICATION

The following is a related application: Electrophotographic Imaging Apparatus and Method Particularly for Color Proofing, Weber et al, Application Ser. No. 348,769, filed Feb. 16, 1982.

The above application is owned by the assignee of this application.

BACKGROUND OF THE INVENTION

The invention relates to a method and apparatus for producing a corona discharge, and more particularly to a method and apparatus for producing a uniform corona along at least one stationary elongate corona electrode.

It is well known that in electrostatic printing equipment a corona generating device including a corona discharge electrode is employed to place positive or negative charges onto a photoconductive member or surface.

The generated corona may be either positive or negative in order to establish a corresponding charge, depending upon the nature of the photoconductive surface employed. When a positive corona is generated from a metallic filament electrode, the resultant charge applied to the photoconductive surface is generally relatively uniform due to the intrinsic uniformity of the nature of a positive corona electrode emission. Many of the currently available electrophotographic devices require a negative corona. When a negative corona is generated from a metallic filament electrode, the photoconductive surface obtains a charge which varies in density from point to point due to the nature of the nonuniform negative corona electrode emission. It is believed that this nonuniformity in charge detrimentally manifests in the developed image since areas containing a higher charge will attract more electrostatic developer material thereto, thereby creating a streaked, nonuniform image appearance.

A number of devices have been developed in order to produce a more uniform negative corona. One such device described by Jarvis, et al., U.S. Pat. No. 3,233,156 includes a rotating corona producing electrode in the form of a helix having a high negative D.C. voltage applied thereto. Rotating the helix has the effect of continuously changing the corona generation sites. This device is considerably limited in its ability to charge a photoconductive surface since the corona generation sites are only those points of the rotating helix immediately adjacent the photoconductive surface. The present invention provides an elongate corona electrode that is active along its entire length thus having significantly improved charging ability over the Jarvis device.

Kuehnle U.S. Pat. No. 3,958,162 describes an improved negative corona producing device which includes a number of elongate corona electrodes, which are positioned parallel to and a predetermined distances from a central axis, and rotated about the central axis while simultaneously applying a corona voltage to each electrode. This device interchanges one corona generating electrode for another corona generating electrode in rapid sequence by the rotating action. The effect of the nonuniformities in each elongate corona electrode are substantially offset, and thereby averaged out, by the rotating action that interchanges the several effective corona generating electrodes, however the pulse like interruption of current flow between the photoconductive surface and each corona generating electrode produced thereby limits the average charging ability of the device.

The present invention provides a method and apparatus for uniformly charging a photoconductive surface. The apparatus includes at least one stationary elongate corona electrode and a moving ground electrode, thereby producing a continuous and substantially uniform corona discharge along the entire length of the stationary elongate corona electrode.

SUMMARY OF THE INVENTION

A method and apparatus for producing a substantially uniform elongate corona region is provided. The apparatus comprises at least one stationary elongate corona electrode, an elongate ground electrode having a series of equally-spaced grounding points disposed along an axis parallel to said stationary elongate corona electrode at a predetermined distance therefrom, means for moving said grounding points along said axis, and a source of corona power coupled to said stationary elongate corona electrode. Bias means coupled to said elongate ground electrode may be provided.

The method includes the steps of applying corona power to at least one stationary elongate corona electrode; moving a series of equally-spaced grounding points defined by an elongate ground electrode along an axis extending parallel to said stationary corona electrode at a predetermined distance therefrom, thereby effecting a substantially uniform corona discharge along the length of said stationary corona electrode.

DETAILED DESCRIPTION OF THE PREFERRED EMBODIMENTS

This invention provides a method and apparatus for producing a substantially uniform elongate corona field effective to produce a negative charge on a photoconductive surface of an electrophotographic member. The negative corona produced by employing the present invention provides the maximum available corona current to be continuously available for charging, while the member moves relative to the corona electrode.

The negative corona field that is produced is substantially uniform due to the influence of the moving ground electrode constantly rearranging the electrostatic field line relationships relative to stationary elongate corona electrode, thereby breaking up any conditions that produce standing field line conditions which lead to nonuniform emissions from the electrode. It is believed that by the effect of breaking up these nonuniform emissions, a more uniform photoconductor charge may be attained.

Figure 1:
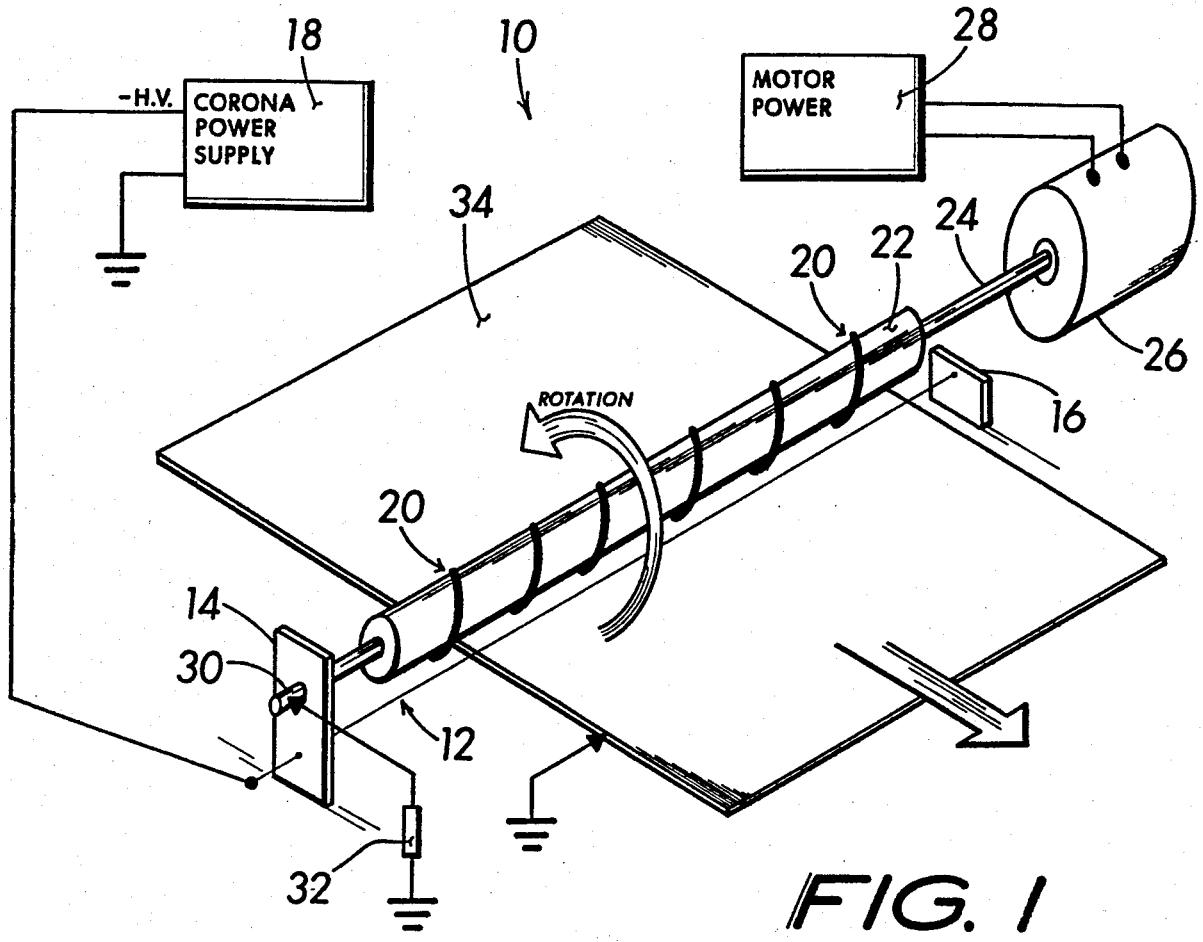
FIG. 1 is a perspective diagrammatic representation of one embodiment of the invention.

Referring first to FIG. 1, there is illustrated a corona producing apparatus according to the invention designated generally by the reference character 10. The corona apparatus includes stationary elongate corona electrode 12 suspended between insulating supports 14 and 16. The corona electrode may be, for example, a stainless steel or tungsten wire having a diameter of about 0.05 millimeter.

A corona power supply 18 is connected to the stationary corona electrode 12. The corona power supply 18 may be a negative high voltage D.C. supply ordinarily providing between 4,000 to 9,000 volts.

An elongate ground electrode 20 is mounted on rod 22, to form a helix. The grounding points are those points of the rotating ground electrode 20 immediately adjacent the stationary corona electrode 12. The ground electrode 20 may be, for example, a stainless steel wire having a 0.25 millimeter diameter. The rod 22 is made of an electrically insulative material, such as glass. The use of glass also conveniently provides mechanical stability, resisting distortion and deterioration in the presence of ozone. The rod 22 is disposed on a shaft 24 which extends from motor 26. The shaft 24 is electrically insulated from the helix 20. A motor power supply 28 is provided that may be, for example, a 115 volt A.C. power supply. The elongate ground electrode 20, wound around rod 22 to form a helix, is coupled to a slipping connection 30 on the extension of shaft 24. The slipping connection 30 is connected through a self-bias means 32 to ground. The self-bias means 32 may be, for example, a 100 megohm resistor, rates for several kilovolts. The motor 26 may rotate rod 22 and ground electrode 20 at a speed of about 1000 rpm. The rotation of electrode 20 continuously moves the grounding points relative to corona electrode 12.

The electrophotographic member to be charged by the apparatus 10 of this invention is identified by the reference numeral 34 and is illustrated as moving in FIG. 1. The stationary elongate corona electrode 12 extends adjacent to the electrophotographic member 34 that is moving thereunder with the longitudinal axis of the electrode 12 defined perpendicular to the direction of travel of member 34. The electrophotographic member 34 may be, for example, 9 inches by 13 inches and the stationary elongate corona electrode being about 10 inches long. The spacing between the stationary corona electrode 12 and the electrophotographic member 34 may be about 9 millimeters with the spacing between the stationary corona electrode 12 and the ground electrode 20 on the order of about 5 millimeters.

Figure 2:
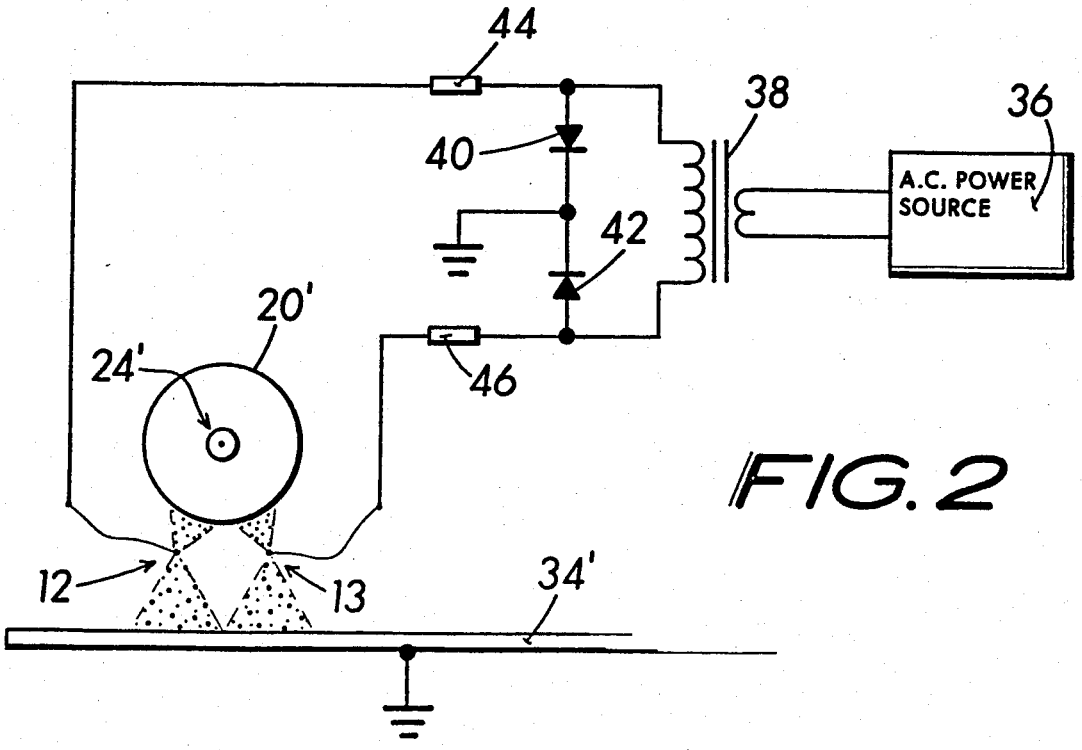
FIG. 2 is a diagrammatic representation of an electrical circuit employable with the apparatus of the invention.

FIG. 2 illustrates an alternate embodiment of a corona producing apparatus 10 employing two stationary elongate corona electrodes 12 and 13. The corona power supply comprises an A.C. power source 36 coupled to a step-up transformer 38 and diodes 40 and 42 and current limiting resistors 44 and 46. The diodes and resitors are arranged with the transformer 38 such that a corona voltage is alternately provided to electrodes 12 and 13. The A.C. power source 36 may be a 60 cylce 115 volt power supply. The step-up transformer 38 may have a step-up ratio of 1:50. The diodes 40 and 42 may be type having a current rating of several milliamperes and a voltage rating of 10 kilovolt P.I.V. The current limiting resistors may have a value of 1 megohm with a power rating of 2 watts. The operation of the corona power supply illustrated in FIG. 2 for use with stationary corona electrodes 12 and 13 is as follows. First consider when anode of diode 40 is negative relative to the anode of diode 42, which occurs on each alternate half-cycle of the power source 36. The negative voltage will cause current to flow through current limiting resistor 44. Meanwhile, the positive voltage appearing at the other end of the transformer secondary at the anode of the diode 42 will cause current to flow through forward conduction of diode 42 to ground. On the alternate half cycle the current will flow through the current limiting resistor 46 with a negative potential at the anode of diode 42. The positive potential at the anode of diode 40 will cause current flow to diode 40 to ground, such that the stationary elongate corona electrodes 12 and 13 will alternately be supplied with a negative high corona voltage on alternate half cycles. The corona thus alternates between the two corona electrodes 12 and 13 thereby serving uniformily to charge the electrophotographic member 34. The elongate ground electrode 20' is rotated by shaft 24' as shown and described relative to FIG. 1.

Figure 3:
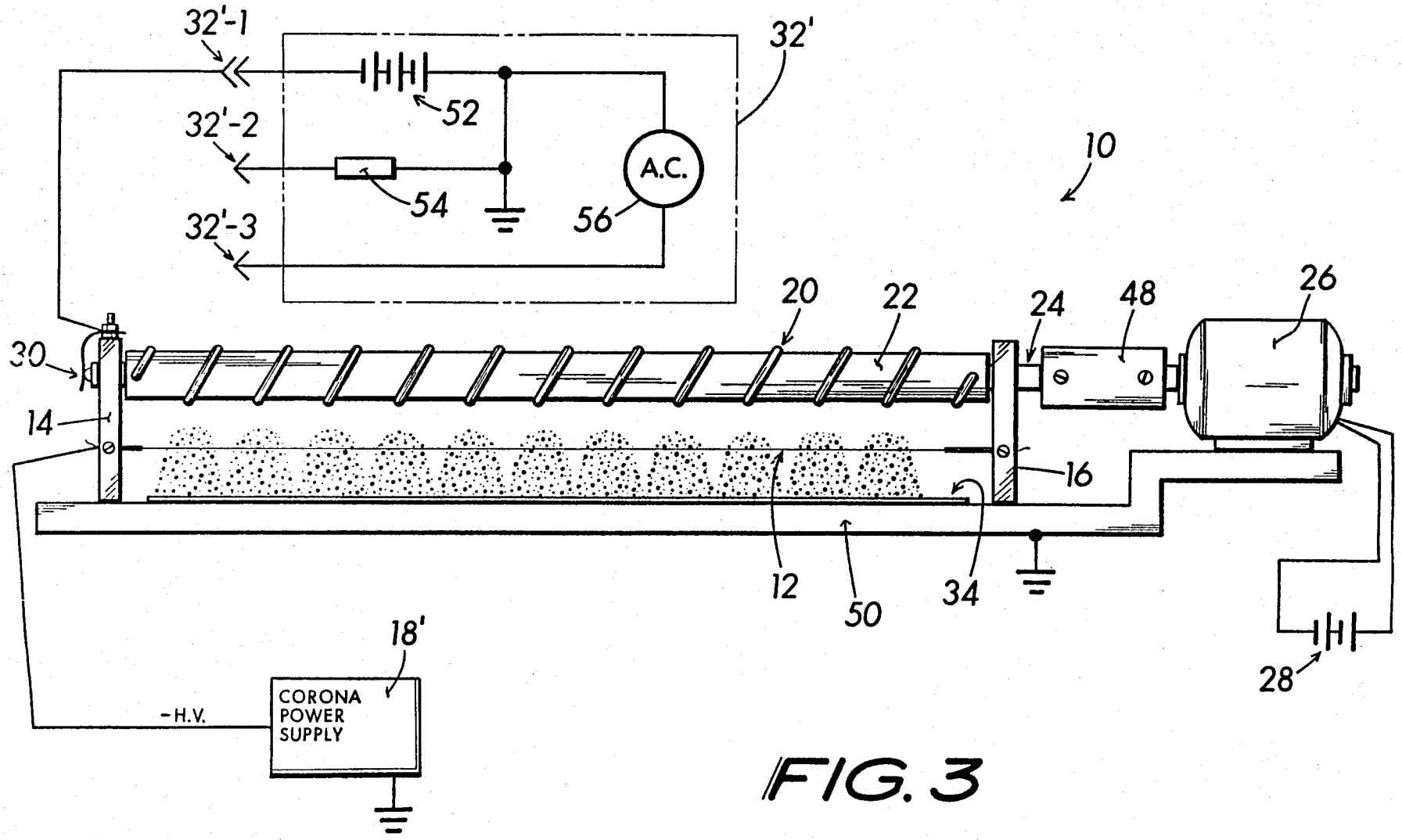
FIGS. 3 and 4 are elevational diagrammatic representations of the apparatus of FIG. 1 illustrating movement.

FIG. 3 illustrates a preferred embodiment of the mechanical arrangement for rotating ground electrode 20. A metal frame 50 supports the member 34 under the stationary elongate corona electrode 12. An insulative coupling 48 connects the motor 26 with the rotating ground electrode support shaft 24. The elongate helical ground electrode 20 is connected to a suitable bias means 32' through a slipping connection 30 that consists of a spring member pressing against the small ball bearing fixed into the end of the electrode support shaft 24. This arrangement is supported by insulating support 14. The stationary elongate corona electrode extends between the insulating supports 14 and 16 which are mounted on frame 50.

Alternative bias arrangements 32' maybe connected to the elongate ground electrode 20 shown in FIG. 3. There is shown a connection 32'-1 wherein a fixed negative D.C. high voltage supply is coupled to the ground electrode 20. Connection 32'-2 shows alternately self bias provided by voltage drop developed across a high value resistor 54 that may be, for example, 100 megohms. The third alternative connection 32'-3 shows an usually unipolar, negative A.C. voltage supply 56 connected to the elongate ground electrode 20. Connection 32'-2 providing a high resistance to ground, being substantially self-biasing and therefore self-compensating, is the preferred connection. As a small corona current flows between the elongate electrode 12 and ground electrode 20, a voltage developed across resistor 54 will increase, and being of the same polarity as the corona electrode potential, serves to reduce the field gradient between the electrodes thereby causing the current flow between the electrode 12 and ground electrode 20 to be relatively small in proportion to the corona charging current to the electrophotographic member 14.

Figure 4:
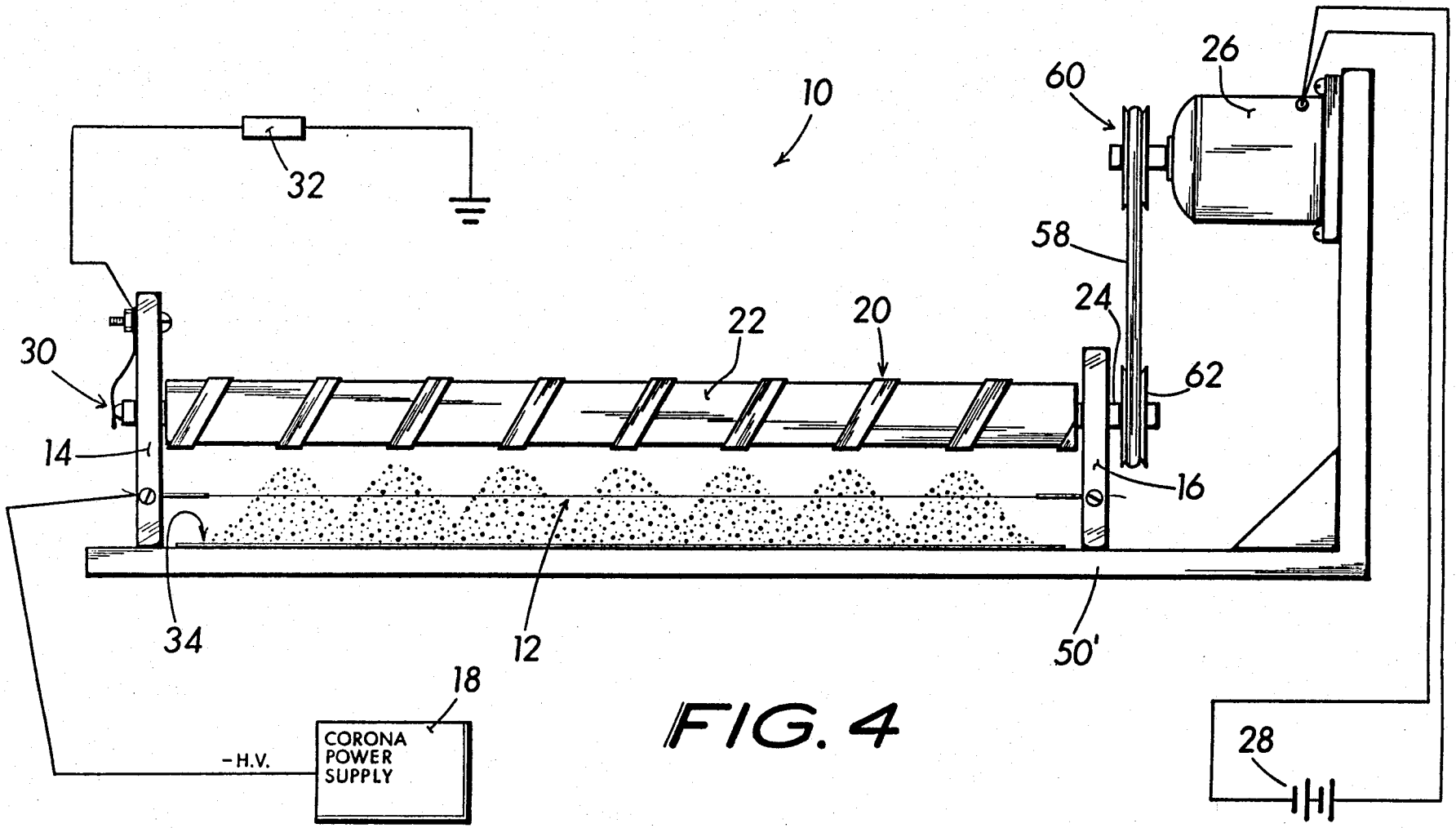

FIG. 4 illustrates another embodiment of corona producing apparatus 10. In this embodiment the elongate ground electrode 20 comprises a flat ribbon and thus provides more surface area than does the wire previously shown in FIGS. 1, 2 and 3, although it is believed that most of the electrical field influence wielded by the ribbon is concentrated near the edges, e.g. discontinuity region of the ribbon electrode. The motor 26 is coupled to a pulley 60 and shaft 24 is coupled to a pulley 62 and endless belt 58 is shown to couple together the pulleys 60 and 62. Belt 58 is made of an insulating material and thereby conveniently serves to insulate the shaft 24 from the motor 26. Rotation of the motor 26 causes shaft 24 and ground electrode 20 to rotate.

Figure 5:
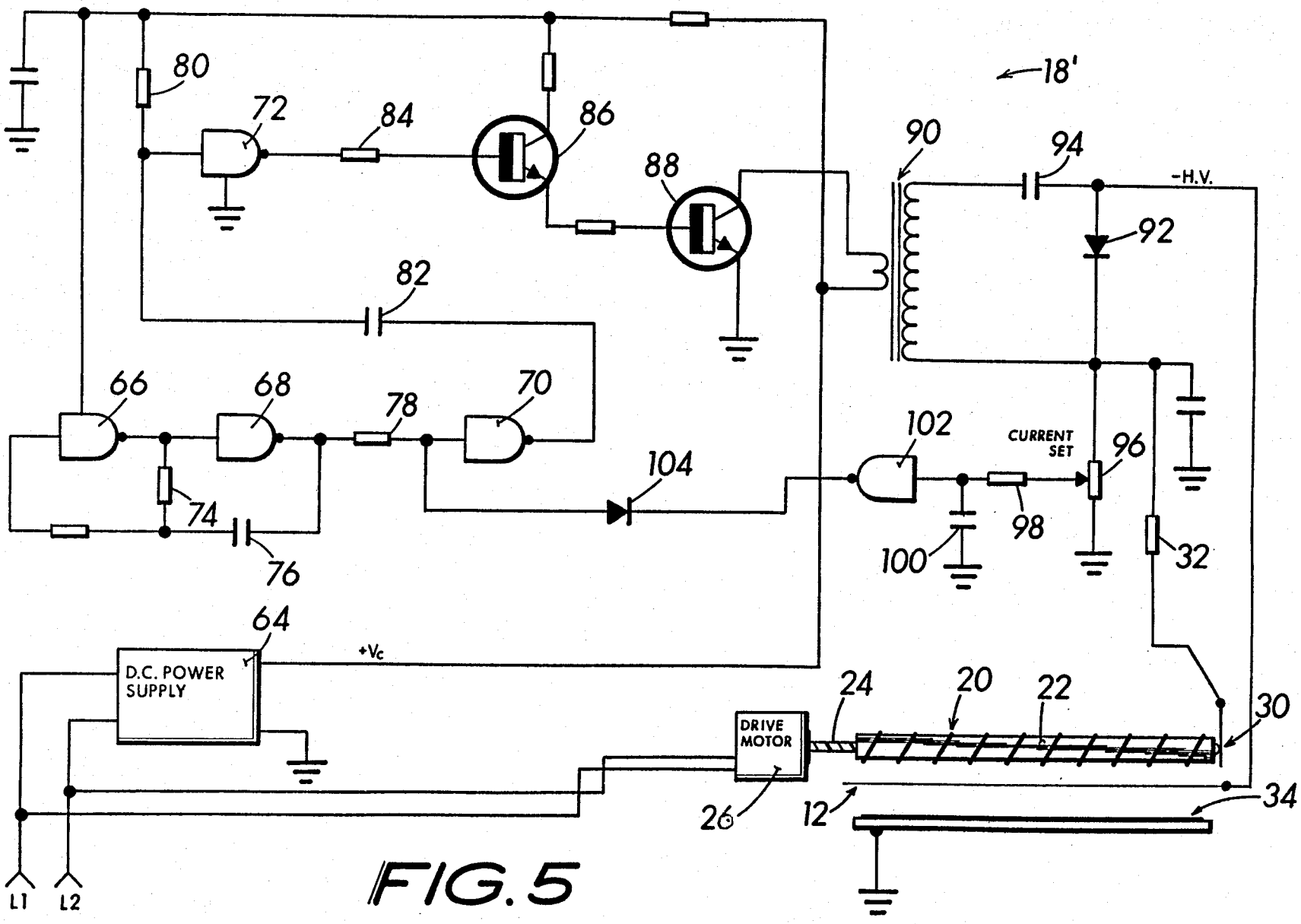
FIG. 5 is a diagrammatic representation of an electrical circuit employable with the apparatus of the invention.

Referring to FIG. 5, a preferred embodiment is illustrated for the corona power supply 18'. A low voltage D.C. power supply 64 provides a positive D.C. voltage indicated as +Vc and provides an input voltage to a multivibrator oscillator including inverters 66 and 68 together with timing resistor 74 and timing capacitor 76 coupled by a resistor 78 to a third inverter 70. This combination produces a train of pulses having a frequency of about 50 kilohertz at the output of the inverter 70 that is coupled by a differentiating network including capacitor 82 and resistor 80, having a time constant considerably shorter than the cycle period of the oscillator pulses, to a fourth inverter 72. The short duration pulse output of the inverter 72 is coupled through a resistor 84 to the base of an NPN transistor 86. The emitter of the NPN transistor 86 couples through a current limiting resistor to the base of power transistor 88. The collector of the power transistor 88 is coupled to the primary of a step-up transformer 90. The other primary connection of the step-up transformer 90 is returned to the +Vc voltage. The secondary of a step-up transformer 90 is connected to a rectifier circuit comprising a diode 92 and capacitor 94 in a shunt rectification configuration. The advantage of shunt rectification is that a high level of ripple is produced, thereby providing a pulating D.C. voltage that may have a high frequency on the order of 50 to several hundred kilohertz, depending on the oscillator time constant. The high frequency component of the corona voltage supply on the stationary elongate 12 is believed to enhance the overall corona performance through preionization of the air surrounding the corona electrode 12 as is commonly evident in radio frequency energy circuits.

The secondary side of transformer 90 is connected to the cathode of diode 92 and potentiometer 96 to ground, and a small positive voltage is produced across the potentiometer 96. A portion of this voltage is tapped by an arm of the potentiometer 96 and is coupled to an integrating network consisting of a resistor 98 and capacitor 100 to an inverter 102. The network time constant may be several milliseconds. The output of the inverter 102 is coupled through a diode 104 to the junction of resistor 78 and the input of inverter 70. In the operation of the corona power supply circuit 18 an increase in current flow through the corona electrode 12 produces a simultaneous increase in the return current through potentiometer 96. This increase in current through potentiometer 96 causes an increased positive voltage on the arm of potentiometer 96 which appears through resistor 98 to the input of inverter 102. As the voltage increases to a set value the output of inverter 102 will go low. The output of inverter 102 is connected to diode 104 and causes forward conduction through diode 104 which will provide a low input voltage to the inverter 70 and inhibit further passage of excitation pulses between the multivibrator and the output circuit. This eliminates the output voltage at the secondary of transformer 90 and likewise the voltage developed across potentiometer 96, thereby reversing the state of the inverter 102 as the integrator delay period is satisfied so that the output of the inverter 102 is high. This enables the continuum of pulses to pass through inverter 70, on to the amplifying transistor 86 and 88 and transformer 90. This on/off action repeats rapidly and will have a time constant as determined by the integrator component values of resistor 98 and capacitor 100. The bias resistor 32 is connected to the elongate ground electrode 20 and the junction of the cathode of diode 92 and a potentiometer 96 thereby increasing the return current through the elongate ground electrode 20.

An example of components that may be used in the corona power supply illustrated in the preferred embodiment thereof in FIG. 5 follows:

| | |
|---|---|
| Inverters (66, 68, 70, 72, and 102) | C-MOS CD4069B |
| NPN transistor 86 | 2N 1711 |
| NPN power transistor 88 | 2N 3055 |
| Diode 92 | 10 Kilovolt P.I.V. H.V. type |
| Diode 104 | IN 914 |
| Resistor 78 | 100 Kilohms |
| Capacitor 76 | 1.8 nanofarad |
| Capacitor 82 | 820 picofarads |
| Resistor 74 | 22 Kilohms |
| Resistor 80 | 10 Kilohms |
| Resistor 84 | 3.3 Kilohms |
| Resistor 98 | 100 Kilohms |
| Capacitor 100 | 10 nanofarads |
| Potentiometer 96 | 50 Kilohms |
| Resistor 32 | 100 megohms |

The invention is not limited to the above example, many variations could be made and the same results achieved.

Figure 6:
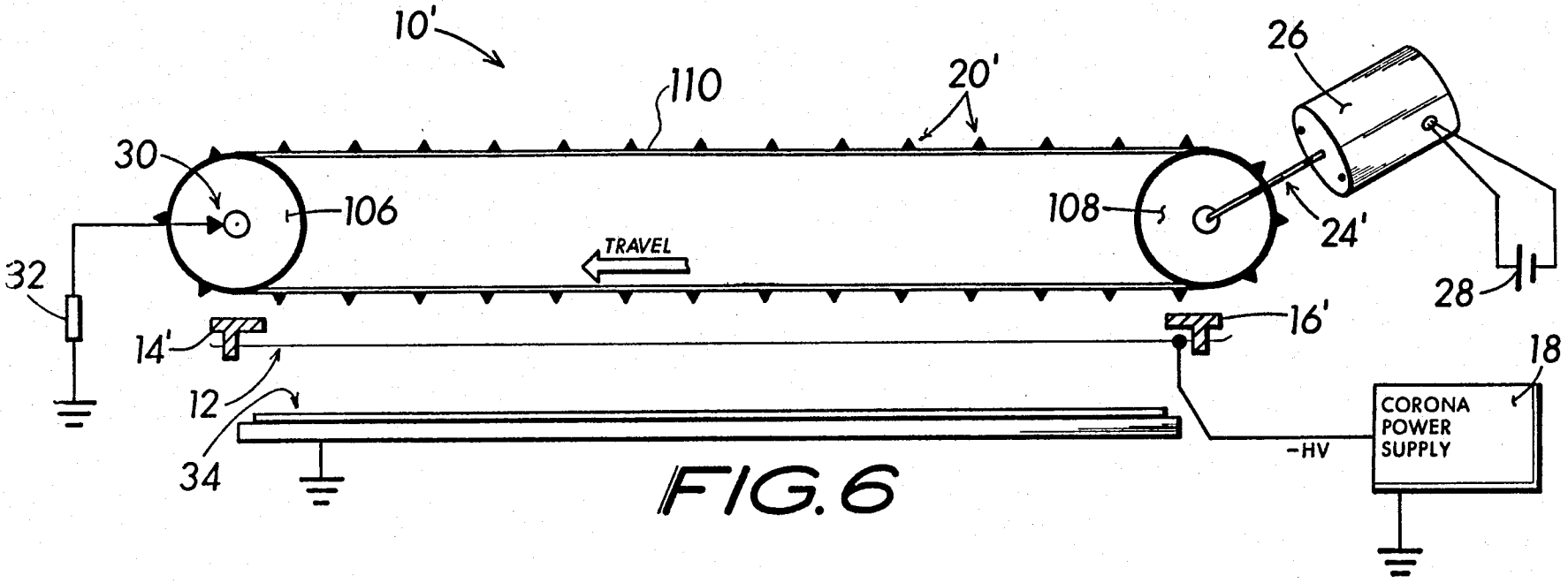
FIG. 6 is an elevational diagrammatic representation of one embodiment of the invention.
Figure 7:
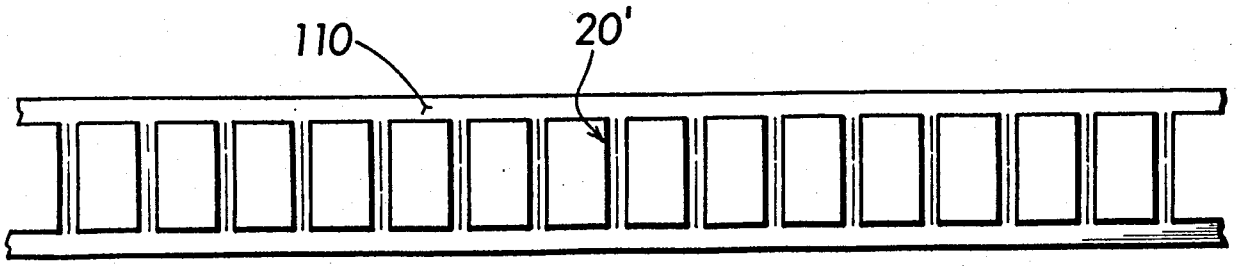
FIG. 7 is a fragmentary plan view of the ground electrode shown in FIG. 6.

FIGS. 6 and 7 show an alternate embodiment of the corona producing apparatus 10 wherein a belt member is used for the elongate ground electrode 110. FIG. 7 illustrates the endless belt having rectangular openings therein to form equally space bridges 20'. The elongate ground electrode 110 is supported by pulleys 106 and 108. Pulley 108 is insulatively connected to a drive motor 26 through a shaft 24. The motor power supply 28 may be a 115 volt A.C. power supply enabling rotation of the motor 26 shaft member which provides the drive for the elongate ground electrode 110, producing a continuous rotation of the endless belt. The belt may rotate at a speed of 200 rpm. A slipping connection 30 is provided at pulley 106 enabling the connection of the elongate ground electrode 110 to a self-bias resistor 32 to ground. Self-bias resistor 32 may be a 100 megohm resistor. A corona power supply 18 providing a source of negative high voltage, is connected to the stationary elongate corona electrode 12 and produces a corona discharge along the length thereof. The bridges 20' define the grounding points immediately adjacent the stationary corona electrode 12. The rotation of the belt that forms the elongate ground electrode 110, moves the bridges 20' over the stationary elongate corona electrode 12 and produces an affinity for the field emanating from the electrode 12, thereby disrupting the corona field and any nonuniformities which might otherwise appear. The result of this action is to minimize the nonuniformities commonly encountered with a negative corona producing apparatus. The elongate ground electrode 110 may be, for example, a 0.15 millimeter thick stainless steel endless belt, with the bridges 20' about 20 millimeter long, spaced about 14 millimeter apart along the belt axis.

Various modifications of the invention are capable of being achieved without departing from the spirit or scope of the invention as defined in the appended claims.

What it is desired to secure by Letters Patent of the United States is:

1. Apparatus for producing a substantially uniform elongate corona discharge comprising:

A. at least one stationary elongate corona electrode;

B. elongate ground electrode having a series of equally-spaced grounding points disposed along an axis parallel to said stationary elongate corona electrode at a predetermined distance therefrom;

C. means for moving said grounding points along said axis; and

D. source of corona power coupled to said stationary elongate corona electrode.

2. The apparatus as claimed in claim 1 wherein said elongate ground electrode comprises a helix arranged on insulating support means.

3. The apparatus as claimed in claim 1 wherein said elongate ground electrode comprises an endless belt arranged on insulating support means.

4. The apparatus as claimed in claim 3 wherein said endless belt provides a plurality of rectangular openings therethrough, forming equally spaced bridges therebetween.

5. The apparatus as claimed in claim 1 wherein said source of corona power includes a high negative D.C. voltage supply.

6. The apparatus as claimed in claim 1 wherein said source of corona power includes a high frequency pulsating D.C. negative high voltage supply.

7. The apparatus as claimed in claim 1 and bias means coupled to said elongate ground electrode.

8. The apparatus as claimed in claim 7 wherein said bias means include a high value resistance.

9. The apparatus as claimed in claim 7 wherein said bias means include a high negative D.C. voltage supply.

10. The apparatus as claimed in claim 7 wherein said bias means include a high frequency pulsating high negative D.C. voltage supply.

11. A method for producing substantially uniform elongate corona including the steps of:

applying a corona power to at least one stationary corona electrode and moving a series of equally-spaced grounding points defined by an elongate ground electrode along an axis extending parallel to said stationary corona electrode at a predetermined distance therefrom, thereby effecting a substantially uniform corona discharge along the length of said stationary corona electrode.

12. The method of claim 11 wherein the step of moving said grounding points includes rotating a helix comprising said elongate ground electrode.

13. The method of claim 11 wherein the step of moving said grounding points includes rotating an endless belt comprising said elongate ground electrode.

* * * * *